US007810853B2

(12) United States Patent
Margheritti

(10) Patent No.: US 7,810,853 B2
(45) Date of Patent: Oct. 12, 2010

(54) VEHICLE DOOR LOCK

(75) Inventor: Enrico Margheritti, Pisa (IT)

(73) Assignee: Intier Automotive Closures S.p.A. (Torino), Corso Allamano (IT)

( * ) Notice: Subject to any disclaimer, the term of this patent is extended or adjusted under 35 U.S.C. 154(b) by 726 days.

(21) Appl. No.: 11/702,933

(22) Filed: Feb. 6, 2007

(65) Prior Publication Data

US 2007/0194577 A1 Aug. 23, 2007

(51) Int. Cl.
*E05C 3/06* (2006.01)
*E05C 3/16* (2006.01)

(52) U.S. Cl. ..... 292/216; 292/DIG. 23

(58) Field of Classification Search ..... 292/216, 292/DIG. 23
See application file for complete search history.

(56) References Cited

U.S. PATENT DOCUMENTS 4,202,571 A * 5/1980 Nishikoori ..... 292/216
4,334,704 A * 6/1982 Yamada ..... 292/216
4,492,395 A * 1/1985 Yamada ..... 292/216
5,071,179 A * 12/1991 Brackmann ..... 292/216
5,181,754 A * 1/1993 Shibata ..... 292/216
5,961,163 A * 10/1999 Brackmann et al. ..... 292/201
5,961,164 A * 10/1999 Gomi ..... 292/216
6,003,910 A * 12/1999 Dupont et al. ..... 292/201
6,142,540 A * 11/2000 Girard et al. ..... 292/216
6,279,972 B1 * 8/2001 Brill et al. ..... 292/216
6,485,071 B2 * 11/2002 Schwaiger ..... 292/216
6,547,291 B1 * 4/2003 Schwaiger ..... 292/216
6,715,806 B2 * 4/2004 Arlt et al. ..... 292/201
7,475,920 B2 * 1/2009 Bigazzi et al. ..... 292/201
7,475,923 B2 * 1/2009 Ottino et al. ..... 292/216
2004/0232708 A1 * 11/2004 Arabia et al. ..... 292/216

FOREIGN PATENT DOCUMENTS

JP 01299980 A * 12/1989
WO WO 03/033847 A1 4/2003

* cited by examiner

*Primary Examiner*—Carlos Lugo
(74) *Attorney, Agent, or Firm*—Clark Hill PLC

(57) ABSTRACT

A vehicle door lock (1) is provided having a lock mechanism (3) cooperating with a striker (5) of a motor vehicle. The lock mechanism (3) has a fork (11), which can be set to a release position, in which it permits engagement and release of a respective seat (15) by the striker (5), and at least one lock position, in which it retains the striker (5) in, and prevents release of, the respective seat (15); a latch (12), which clicks onto the fork (11) to lock it releasably in the lock position; a release member (6) operated selectively to release the latch (12) from the fork (11) and allow the fork (11) to move into the release position; and interacting portions (42, 43) whereby the fork (11) and the release member (6) interact to define different indicating positions of the release member (6) corresponding to the release position and lock position of the fork (11) respectively.

11 Claims, 4 Drawing Sheets

VEHICLE DOOR LOCK

BACKGROUND OF THE INVENTION

1. Field of the Invention

The present invention relates to a vehicle door lock.

2. Description of the Related Art

As is known, vehicle doors normally comprise a frame-like top portion defining a window frame closed by a movable window when the window is raised; and a box-like bottom portion comprising an outer panel and an inner panel joined at one end by an end edge and defining in between a cavity normally housing the window, when the window is lowered, and various component parts fixed to the panels, such as a lock and a window regulating device. The cavity in the door is often divided by an intermediate waterproof partition into a dry inner area bounded by the inner panel, and a damp outer area, i.e. exposed to water and atmospheric humidity, bounded by the outer panel and normally housing the window when the window is lowered.

Conventional locks are normally fitted in the damp area of the door cavity, in such a position as to interact with a striker integral with a fixed door post.

More specifically, conventional locks substantially comprise a lock mechanism for releasably engaging the striker to lock the door; and an actuating assembly for releasing the lock mechanism from the striker, and connectable to the manual control members on the vehicle door, such as the inside and outside handles and the key assembly.

More specifically, the actuating assembly normally comprises an inner control lever connected to the inside door handle; an outer control lever connected to the outside door handle; and a safety mechanism operated by a key from outside the vehicle, and by a button and/or the inside handle, and which assumes a safety-on configuration, in which the outer control lever is rendered ineffective, thus preventing the door from being opened using the outside handle, and a safety-off configuration allowing the door to being opened using the outside handle.

In vehicles with centralized door-locking systems, the actuating assembly also comprises a door-lock actuator and possibly electric indicator and control components, such as microswitches.

Locks of the above type are known in which the lock mechanism and the actuating assembly are integrated and assembled sequentially on a single supporting body.

This so-called integrated solution has various manufacturing and functional drawbacks. Firstly, production lacks the versatility necessary to produce locks of different versions (mechanical or electric, for front and rear doors) or for different applications: integrated, sequential assembly does not allow for switching easily from one lock version to another, or for making design changes as required as a function of market demand. Moreover, lock component parts can only operate, and therefore be tested, when assembled. Which therefore makes it difficult to immediately locate a specific faulty part during testing.

To eliminate the above drawbacks, modular locks are widely used, in which the supporting body comprises two or more shells, each supporting and housing a given number of lock components, which are assembled in a modular fashion. More specifically, modular locks are known which substantially comprise a shell supporting and housing the lock mechanism, and a shell supporting and housing the actuating assembly; and the shells are fitted together, e.g. by means of fast-fit connecting devices, to form an integrated unit. The modular structure of such locks allows the lock mechanism and the actuating assembly to be produced and tested independently, and also permits mass-production saving by producing one module containing the lock mechanism, and to which are connected various module versions containing respective types of actuating assemblies to "customize" the lock for different applications: fully-mechanical, with a door lock actuator, and/or with indicator functions.

Whether they have a single or modular supporting body, for the locks described to cooperate with the striker, they must be located in a given position inside the cavity in the bottom portion of the door. Which primarily poses problems in terms of the size and shape of the lock and component modules, to adapt the size of the lock to the space available. Moreover, as stated, to interact with the striker, the lock is normally located inside the damp area of the door cavity, which means a whole range of provisions must be made to prevent contact with water from impairing operation of the lock, such as employing airtight electric components, which are far more expensive than equivalent components requiring no waterproofing.

Finally, in the case of doors hinged to the door post, the normal location of the lock, on the opposite side of the door to the hinge, requires that the electric, electronic, and mechanical parts of the lock be sufficiently strong to withstand the inertial stress produced by slamming the door, and which is obviously in direct proportion to the distance from the hinge.

The above drawbacks have recently been eliminated by the Applicant with the design of an entirely new modular lock (detailed in International Patent Application No. PCT/ITO2/00671), in which the actuating assembly and the lock mechanism are connected by remote connecting means, and can therefore be located, together with the respective supporting shells, any distance apart inside the door.

By means of this solution, location of the actuating assembly inside the door cavity is therefore independent of that of the lock mechanism, which depends on the position of the striker. This therefore simplifies sizing and design of the module containing the actuating assembly, and enables the module itself to be housed in the most favorable position inside the door cavity, e.g. in the dry inner area, thus eliminating the need for high-cost airtight electric components, while at the same time drastically reducing the risk of break-in and, hence, security system design, manufacturing, and assembly cost.

Alongside the numerous advantages referred to above, however, the new modular lock has the drawback of requiring electric indicator components to indicate the full-lock position of the fork. In other words, to indicate when the door is open or ajar, or to indicate when the door is closed, as required for example to deactivate the actuators of electrically operated locks, airtight electric components are required, which can be located next to the fork in the damp area of the door, and which therefore limit the above advantages, particularly in terms of cost.

It is an object of the present invention to provide a vehicle door lock designed to provide a straightforward, low-cost solution to the above drawback of known locks.

SUMMARY OF THE INVENTION

According to the present invention, there is provided a vehicle door lock, comprising a lock mechanism cooperating with a striker. The lock mechanism comprises a fork which can be set to a release position, in which the fork permits engagement and release of a respective seat by the striker, and at least one lock position, in which the fork retains the striker in and prevents release of the seat. A latch engages the fork to lock it releasably in the lock position and a release member is operated selectively to release the latch from the fork and allow the fork to move into the release position. The lock mechanism further includes interacting members, whereby the fork and the release member interact to define different indicating positions of the release member corresponding to the release position and the lock position of the fork, respectively.

BRIEF DESCRIPTION OF THE DRAWINGS

A preferred, non-limiting embodiment of the present invention will be described by way of example with reference to the accompanying drawings, in which.

DETAILED DESCRIPTION OF THE PREFERRED EMBODIMENT

Figure 1:
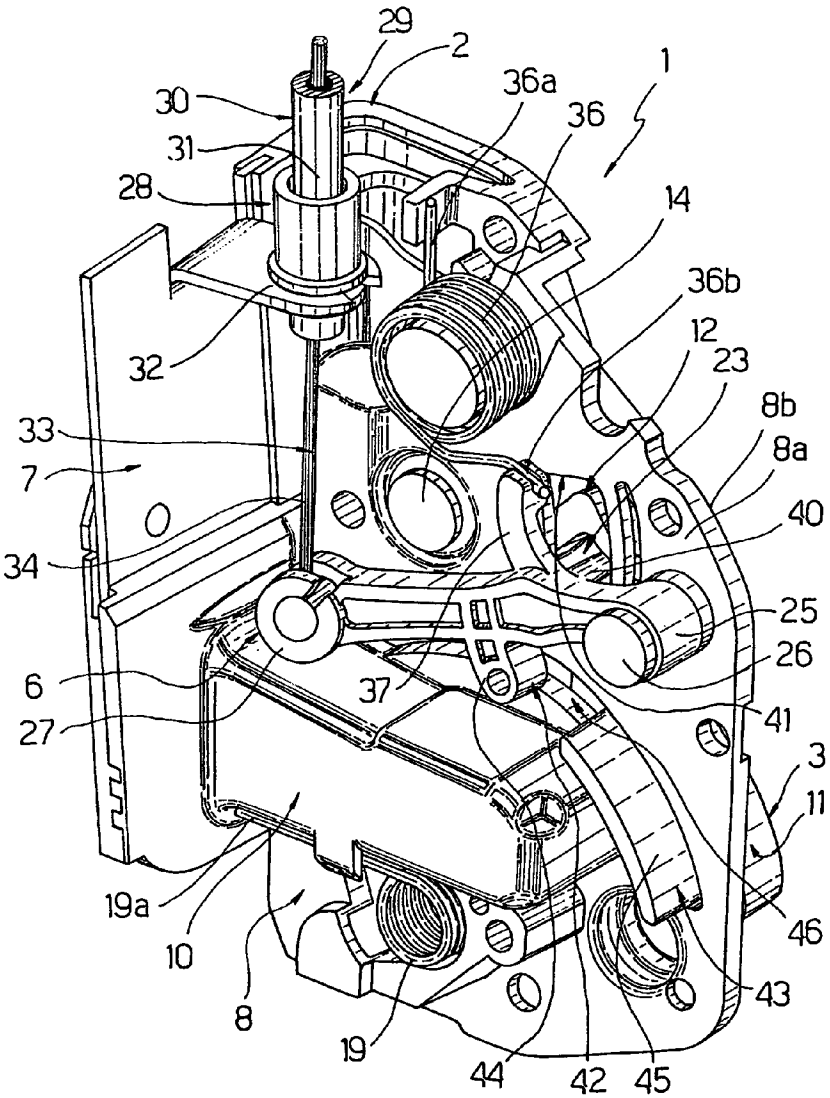
FIG. 1 is a perspective view, with parts removed for clarity, of a vehicle door lock in accordance with the present invention and in a full-lock position.

Referring to the Figures, a lock, generally shown at 1, comprises a supporting body 2 fixed in known manner to the vehicle door; a lock mechanism 3 secured to supporting body 2 for releasably engaging a cylindrical portion 4 of a striker 5 (shown only partly in FIGS. 3, 5, 7) integral with a fixed post (not shown) of the door; and a release lever 6 activated selectively to release lock mechanism 3 from striker 5.

In an alternative embodiment not shown, striker 5 may be fixed to the door; and supporting body 2, together with lock 1, may be fixed to the door post.

For the sake of simplicity, of supporting body 2, the accompanying drawings show only two plates 7, 8 fixed perpendicularly to each other at a common end edge to define a substantially L-shaped profile when viewed along a plane perpendicular to both plates 7, 8.

Supporting body 2 defines a C-shaped lateral opening 9 extending along both plates 7 and 8 from the common end edge, and for receiving portion 4 of striker 5 when closing the door.

More specifically, opening 9 comprises a substantially quadrangular inlet portion (not shown in the accompanying drawings) extending through plate 7; and a receiving portion 9*b* extending along plate 8 and closed on the opposite side to the inlet portion. As shown in FIG. 1, on a face 8*a* of plate 8 facing plate 7, opening 9 is covered by a casing 10 fixed to both plates 7, 8 and defining a seat for receiving striker 5.

Figure 3:
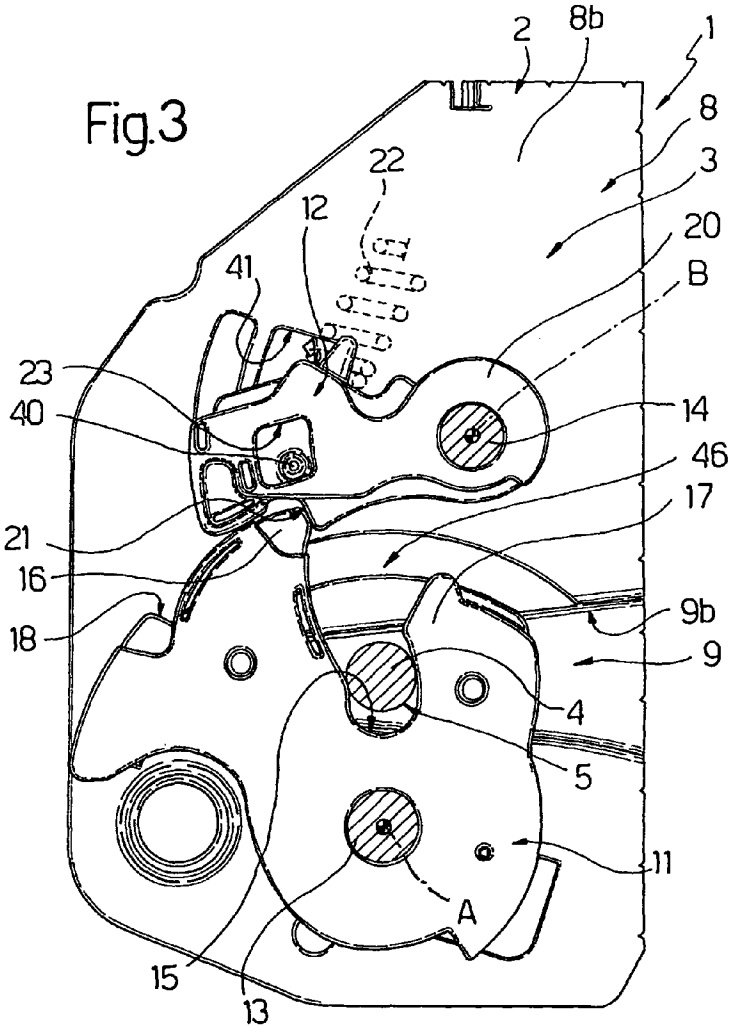
FIGS. 2 and 3 show opposite side views of the lock of FIG. 1.
Figure 5:
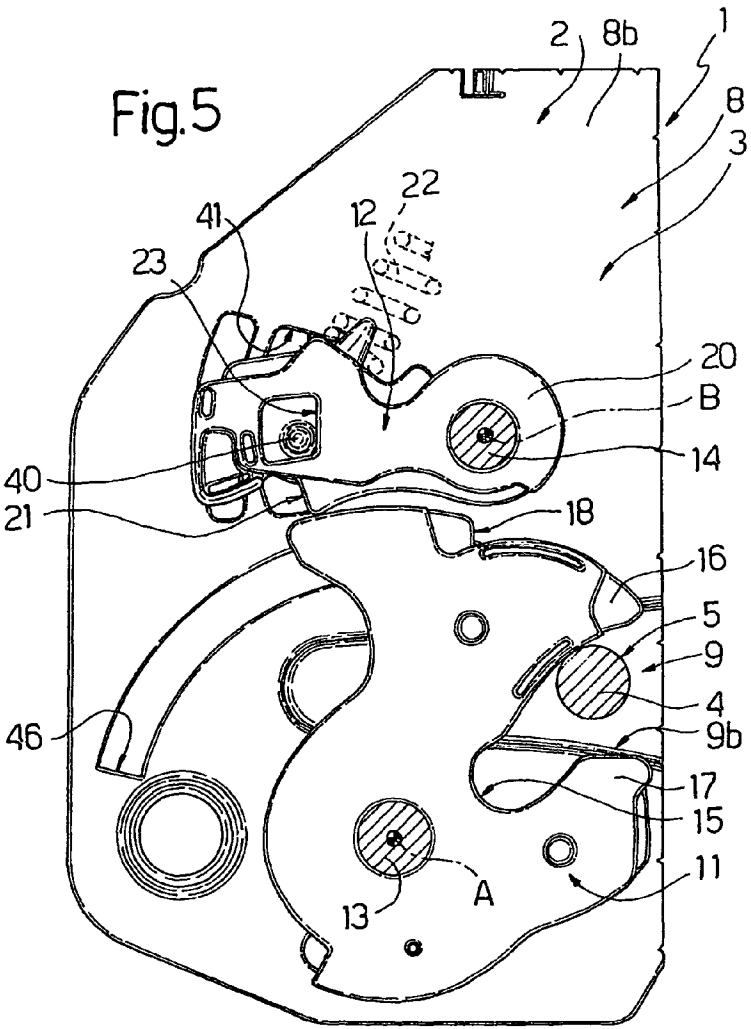
FIGS. 4 and 5 show opposite side views of the lock of FIG. 1 in a release position.
Figure 7:
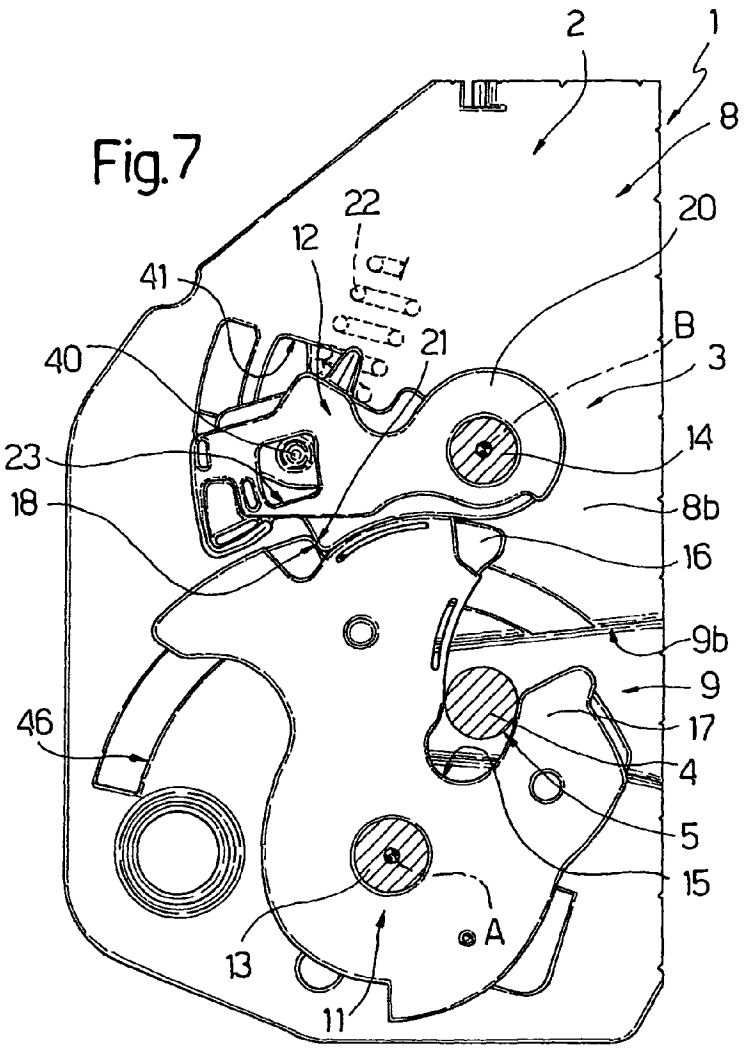
FIGS. 6 and 7 show opposite side views of the lock of FIG. 1 in a pre-lock position.
Figure 6:
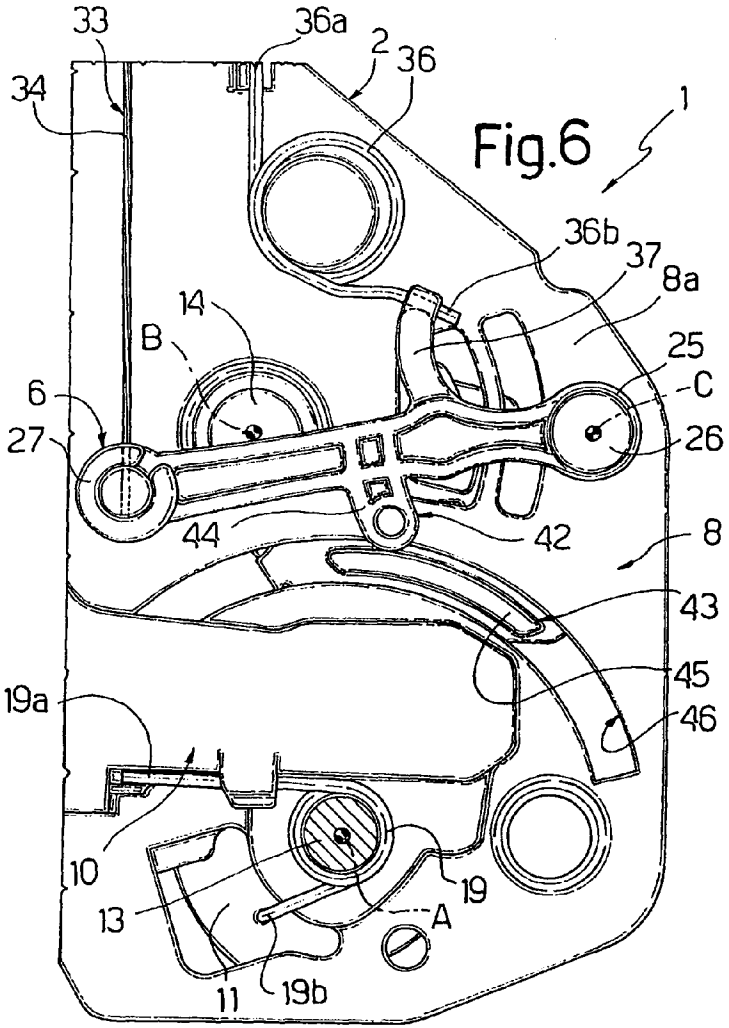

With particular reference to FIGS. 3, 5 and 7, lock mechanism 3 is secured to a face 8*b* of plate 8 opposite face 8*a*, and substantially comprises a fork 11 and a latch 12 hinged about respective fixed pins 13, 14 integral with plate 8 and having respective axes A, B parallel to each other and perpendicular to plate 8.

Fork 11 is defined by a contoured plate hinged at an intermediate portion about pin 13, and has a C-shaped peripheral seat 15 bounded laterally by two teeth 16, 17 for receiving portion 4 of striker 5.

A spring 19, wound about pin 13 on the face 8*a* side of plate 8, pushes fork 11 in known manner into a release position (FIGS. 4 and 5) wherein seat 15 faces the same way as opening 9 in supporting body 2, and so permits engagement and release of portion 4 of striker 5. Spring 19 has one end 19*a* secured to plate 8 and adjacent to casing 10; and an opposite end 19*b* secured to fork 11.

When the door is slammed, fork 11 is rotated by striker 5 about axis A to lock or click onto latch 12, as explained in detail below, in two different positions: a prelock or first-click position (FIG. 7); and a full-lock or second-click position (FIG. 3), in which portion 4 of striker 5 is locked inside seat 15 and prevented from withdrawing by tooth 17 increasingly closing off receiving portion 9*b* of opening 9.

As fork 11 rotates to click onto latch 12, the prelock position is therefore interposed between the release position and the full-lock position.

As shown in FIGS. 3 and 7, the full-lock and prelock positions are defined respectively by latch 12 engaging the free end of tooth 16 (FIG. 3), and a shoulder 18 (FIG. 7) formed along the peripheral edge of fork 11, on the side defining tooth 16 on the opposite side to seat 15.

Latch 12 is defined by a contoured plate extending substantially in the same plane as fork 11 and on one side of the fork 11 and opening 9.

Latch 12 is elongated in shape from an end portion 20 hinged to pin 14, and defines, on the side adjacent to fork 11, a lateral shoulder 21 spaced apart from end portion 20 hinged to pin 14. Shoulder 21 provides for releasably engaging shoulder 18 and the free end of tooth 16 of fork 11 to define the prelock position and the full-lock position of fork 11, respectively.

Latch 12 is pushed in known manner towards fork 11 by a known garter spring 22 (shown only partly by the dash line in FIGS. 3, 5, 7) interposed between latch 12 and a shoulder (not shown) integral with plate 8.

By means of release lever 6, latch 12 is movable selectively, in opposition to spring 22, to release fork 11 and striker 5 so the door can be opened. More specifically, release lever 6 acts on latch 12 at a slot 23 formed in the body of latch 12 and adjacent to shoulder 21.

Release lever 6 extends along face 8*a* of plate 8, and is hinged to face 8*a* by an end portion 25. More specifically, end portion 25 of release lever 6 is hinged about a pin 26 fixed to plate 8, projecting therefrom on the face 8*a* side, and having an axis C parallel to axes A and B.

Release lever 6 is also acted on at an end portion 27 opposite end portion 25.

More specifically, end portion 27 of release lever 6 is connected by a transmission device 28 (only shown partly in FIGS. 1, 2, 4, 6) to a known control member (not shown) located on the door in a remote position with respect to lock 1, and which may be defined, for example, by a door handle, or by a lock 1 actuating device of the type described in International Patent Application No. PCT/ITO2/00671, the content of which, relative to the lock, is considered incorporated herein by way of reference.

In the example shown, transmission device 28 comprises a flexible cable 29, e.g. a Bowden cable, of which is shown only the part connected to supporting body 2 and interacting with release lever 6. More specifically, cable 29 comprises a sheath 30 having an end portion 31 fixed to a projection 32 of plate 7; and a core 33, which slides axially with respect to sheath 30 and has an end portion 34 secured to end portion 27 of release lever 6.

As stated, the end portions (not shown) of sheath 30 and core 33 of cable 29 opposite respective end portions 31 and 34 are connected to a member integral with the door, and to the remote control member, respectively.

As shown in FIGS. 1, 2, 4 and 6, release lever 6 is loaded by a garter spring 36 in the same direction as latch 12, i.e. towards casing 10, and therefore towards opening 9.

More specifically, spring 36 has one end 36*a* to face 8*a* of plate 8 of supporting body 2, and an opposite end 36*b* fixed to an arm 37 extending laterally from release lever 6 and parallel to face 8*a*.

Release lever 6 also comprises an intermediate projection 40 extending loosely through a slot 41 through plate 8, and loosely engaging slot 23 in latch 12.

The clearance between slot 23 and projection 40 is so sized as to make latch 12 and release lever 6 independent when release lever 6 is idle. Obviously, when release lever 6 is activated to release latch 12 from fork 11, the initial travel of release lever 6 is ineffective until projection 40 contacts the edge of slot 23 in latch 12; and only from this point on does further movement of release lever 6 into a work position produce a corresponding movement of latch 12 to detach the latch from fork 11.

In the absence of external forces, release lever 6 is subjected solely to the force of spring 36, which pushes it into a first rest position (FIGS. 1 and 2), in which end portion 27 rests on casing 10. As explained in detail below, this first rest position can only be assumed by release lever 6 when fork 11 is in the full-lock position.

Release lever 6 and fork 11 advantageously comprise respective interacting portions 42, 43, which cooperate mutually, in the release and prelock positions of fork 11, to define a second rest position of release lever 6, distinct from the first rest position and interposed between the first rest position and the work position.

The different rest positions assumed by release lever 6 for different positions of fork 11 may be transmitted mechanically to the remote control member to indicate failure of fork 11 to reach the full-lock position, with no need for any electrical components.

As shown in FIGS. 1, 2, 4 and 6, interacting portion 42 is defined by an arm 44 projecting from release lever 6, on the opposite side to that from which arm 37 extends, and parallel to face 8*a* of plate 8; and interacting portion 43 is defined by an elongated cam projection 45 extending perpendicularly from fork 11 and engaging in sliding manner a through slot 46 formed in plate 8.

More specifically, projection 45 projects through slot 46 on the face 8*a* side of plate 8, so as to contact the free end of arm 44 of release lever 6.

Projection 45 of fork 11 and slot 46 are both in the form of an arc of a circle with its center defined by axis A of pin 13; slot 46 is of such an extension as to allow fork 11 to rotate completely from the release position to the full-lock position; and cam projection 45 is of such an extension as to cooperate with the free end of arm 44 of release lever 6 in the release and prelock positions of fork 11, but not in the full-lock position.

In an alternative embodiment not shown, interacting portions 42 and 43 may be of such shape and extension as to cooperate mutually in the full-lock position of fork 11, and be detached in the prelock and release positions of fork 11.

In actual use, lock 1 is engaged, from inside or outside the vehicle, by simply slamming the door. By so doing, portion 4 of striker 5 impacts tooth 16 of fork 11, which rotates counterclockwise from the release position (FIG. 5) to the pre-lock (FIG. 7) and full-lock (FIG. 3) positions.

Figure 4:
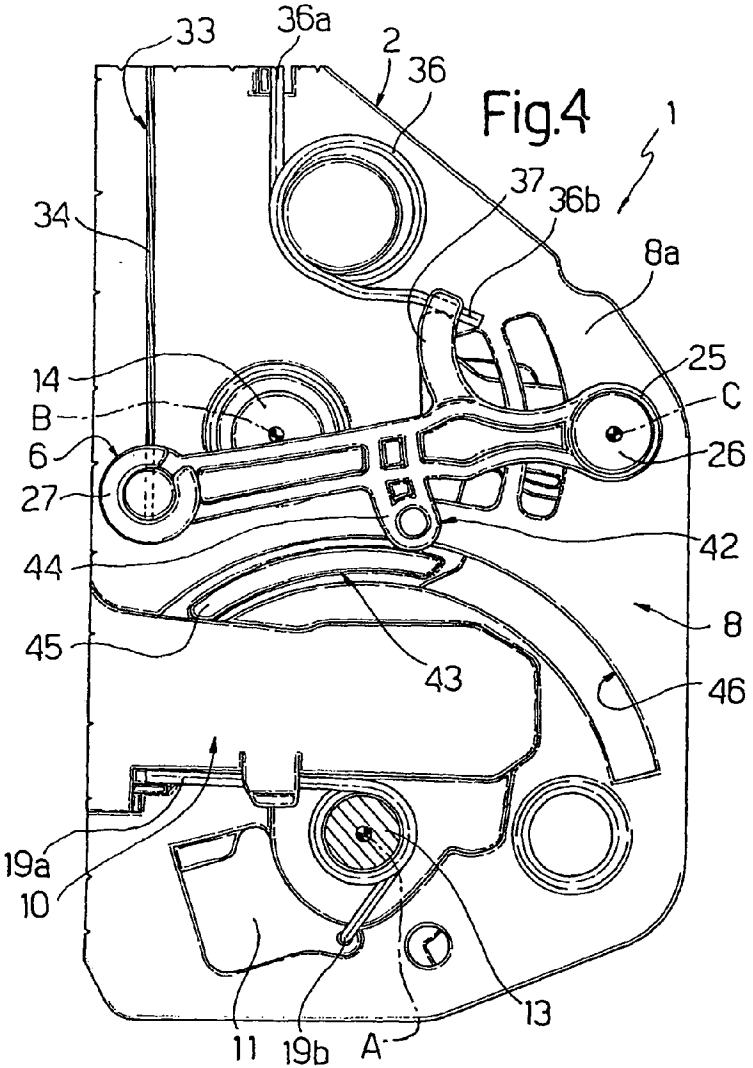

As shown in FIG. 4, in the release position of fork 11, projection 43 cooperates with the free end of arm 44 of release lever 6 to keep release lever 6 in the second rest position. By virtue of the clearance between slot 23 in latch 12 and projection 40 of release lever 6, the position assumed by latch 12, contacting the peripheral edge of fork 11, has no effect on the position of release lever 6.

Rotation of fork 11 first causes its peripheral edge to slide along the edge of shoulder 21 of latch 21, so that release lever 6 is still maintained in the second rest position by the interaction of projection 45 of fork 11 and arm 44 of release lever 6. More specifically, as fork 11 rotates as described above, projection 45 slides along the free end of arm 44 of release lever 6.

If the door is slammed forcefully enough, the impact of striker 5 on tooth 16 of fork 11 pushes tooth 16 of fork 11 past shoulder 21 of latch 12, so that spring 22 clicks latch 12 further towards fork 11, with shoulder 21 positioned in front of the free end of tooth 16. Fork 11 is prevented from being sprung back by spring 19 into the release position by tooth 16 resting against shoulder 21 of latch 12, and so remains locked in the full-lock position, in which tooth 17 closes off opening 9 of supporting body 2 to prevent withdrawal of striker 5 from opening 9.

Figure 2:
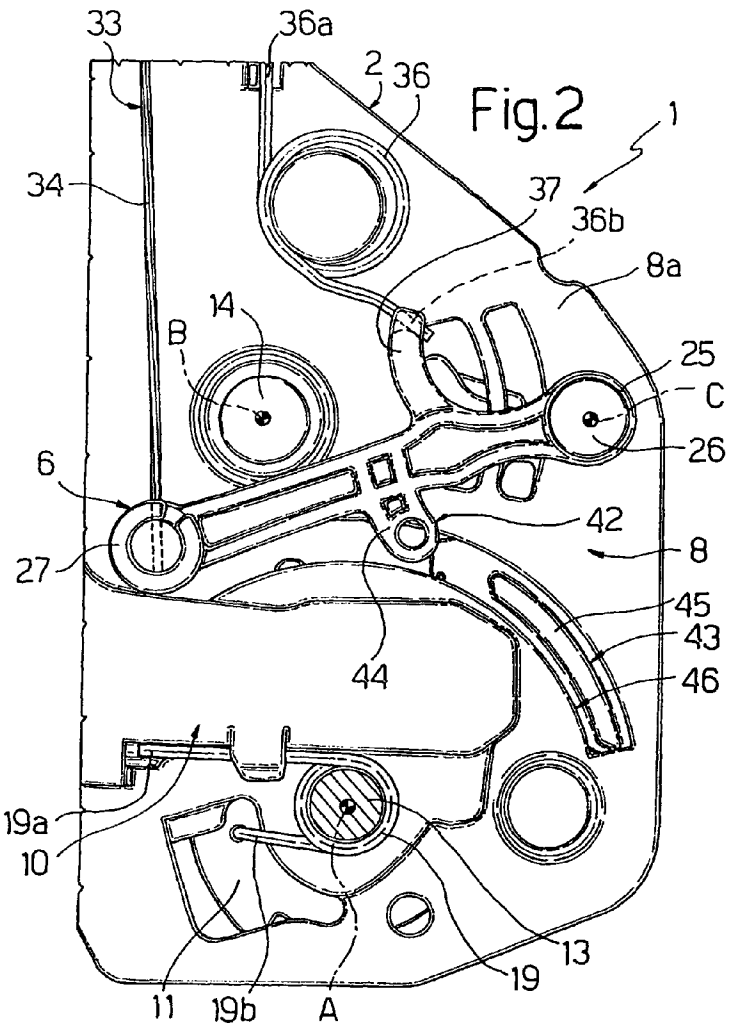

As shown in FIGS. 1 and 2, in the full-lock position of fork 11, arm 44 of release lever 6 and projection 45 of fork 11 are detached, so that release lever 6 can be moved by spring 36 into the first rest position to indicate, by means of transmission device 28, the full-lock position of fork 11.

If the door is not slammed forcefully enough to push fork 11 into the full-lock position, so that shoulder 18 is simply pushed past shoulder 21 of latch 12, latch 12 locks fork 11 in the prelock position (FIG. 7), in which projection 45 of fork 11 and arm 44 of release lever 6 interact mutually to keep release lever 6 in the second rest position, thus indicating to the user, by means of transmission device 28, that the door is not fully locked.

Lock 1 is released by simply operating release lever 6 in opposition to spring 22. Initially, release lever 6 is ineffective until projection 40 is brought to rest against the edge of slot 23 in latch 12, at which point, release lever 6 begins to actually exert thrust on latch 12 to release it from fork 11.

Once fork 11 is in the release position, thus releasing striker 5 from seat 15 and opening 9 of supporting body 2, latch 12 is pushed by spring 22 onto the peripheral edge of fork 11, and release lever 6 is pushed by spring 36 into the second rest position. If the door is closed again, when the fork reaches the prelock position, latch 12 clicks onto shoulder 18 of fork 11, while release lever 6 remains in the second rest position. This independent movement of latch 12 with respect to release lever 6 is achievable by virtue of the clearance between projection 40 and slot 23 engaged by the projection. Even when next switching to the full-lock position of fork 11, the positions of latch 12 and release lever 6 have no effect on each other.

By virtue of the interaction of fork 11 and release lever 6, release lever 6 may assume different positions, depending on whether or not fork 11 is in the full-lock position; and the different positions of release lever 6 may be used to indicate incomplete closure of the door or, in the case of locks activated by a known electric actuator (not shown), as a signal to deactivate the actuator.

Since the above indication is obviously achieved with no need for electric components, a fully mechanical module of lock 1 may be produced for location, as required, in the damp area of the door, in such a position as to interact with striker 5; and the remaining electric components cooperating with the fully mechanical module, including, for example, electric actuators, sensors, microswitches, conducting tracks, cables, etc., may easily be housed entirely in the dry area of the door and connected to the mechanical module by remote transmission devices, such as device 28.

Clearly, changes may be made to lock 1 without departing from the scope of the present invention. Additionally, the term "door" is used broadly speaking to indicate any member movable between an open position and a closed position, respectively opening and closing an access opening to an inner compartment of a vehicle, and therefore also may include boot and bonnet lids and rear hatches, in addition to the side doors of vehicles as referred to in the description purely by way of example.

The invention claimed is:

1. A vehicle door lock (1) comprising a lock mechanism (3) cooperating with a striker (5), said lock mechanism (3) comprising:

a fork (11) having a seat (15), said fork (11) can be set to a release position, in which said fork permits engagement and release of the seat (15) by the striker (5), and a full-lock position, in which the fork retains the striker (5) in, and prevents release of, the respective seat (15), said fork (11) including a cam projection (45) defining a surface having a first end and an opposed second end;

a latch (12) which engages said fork (11) to lock it releasably in said full-lock position; and a release member (6) movable between a first rest position and a second rest position, said release member (6) operated selectively to release said latch (12) from said fork (11) and allow the fork (11) to move into said release position, said release member (6) including an arm (44) projecting therefrom having a free end;

when said fork (11) is in said release position, said free end of said arm (44) contacts said cam projection (45) proximate said first end thereof to maintain said release member (6) in said second rest position, and when said fork (11) is in said full-lock position, said free end of said arm (44) does not contact said cam projection (45) and said release member (6) moves into said second rest position which indicates that said fork (11) is in said full-lock position.

2. A lock as claimed in claim 1, characterized in that said release member (6) is loaded by a bias member (36) into said first rest position, and is moved, in opposition to said bias member (36), into said second rest position in which said release member releases said latch (12) from said fork (11) to move said fork (11) from said full-lock position to said release position.

3. A lock as claimed in claim 1, characterized in that said fork (11) can also be set to a prelock position, with respect to said latch (12), interposed between said release position and said full-lock position; and said arm and said cam projection also cooperate with each other in said prelock position of said fork (11).

4. A lock as claimed in claim 3, characterized in that said latch (12) and said release member (6) comprise coupling means (23, 40) which are only active along part of the movement of said release member (6) from said first rest position to said second rest position.

5. A lock as claimed in claim 4, characterized in that said coupling means comprise an opening (23) and a male member (40), which are carried selectively by said latch (12) and said release member (6), respectively, and which engage loosely in the direction of their relative movement.

6. A lock as claimed in claim 1, including a transmission device (28) connecting said release member (6) to a control member for transmitting mechanically to the control member the position of said fork (11) based on the position of said release member (6).

7. A vehicle door lock (1) comprising a lock mechanism (3) cooperating with a striker (5), said lock mechanism (3) comprising:

a fork (11) movable between a release position, in which said fork does not retain the striker (5), a pre-lock position, and a full-lock position, in which the fork retains the striker (5), said fork (11) including a cam projection (45) defining a surface having a first end and an opposed second end;

a latch (12) engageable with said fork (11) to retain said fork in one of said pre-lock and full-lock positions; and a release member (6) movable between a first rest position and a second rest position, said release member (6) operably coupled to said latch to selectively release said latch (12) from said fork (11) when said fork (11) is in said full-lock position to allow said fork (11) to move into said release position, said release member (6) including an arm (44) extending out therefrom having a free end;

when said fork (11) is in said release position said free end of said arm (44) contacts said cam projection (45) proximate said first end to maintain said release lever (6) in said second rest position, when said fork (11) is in said pre-lock position said free end of said arm (44) contacts said cam projection (45) proximate said second end to maintain said release lever (6) in said second rest position, and when said fork (11) is in said full-lock position said free end of said arm (44) does not contact said cam projection (45) and said release lever (6) moves into said first rest position which indicates that said fork (11) is in said full-lock position.

8. A lock as claimed in claim 7 wherein said release member (6) is loaded by a bias member (36) into a first rest position and is moved in opposition to said bias member (36) into a second rest position, in which said release member releases said latch (12) from said fork (11).

9. A lock as claimed in claim 8 wherein said latch (12) and said release member (6) include coupling means (23, 40) which are only active along part of the movement of said release member (6) from said first rest position to said second rest position.

10. A lock as claimed in claim 9 wherein said coupling means includes an opening (23) and a male member (40) carried by said latch (12) and said release member (6) respectively for selective engagement during movement of said release member (6) and said latch (12).

11. A lock as claimed in claim 8 including a transmission device (28) connecting said release member (6) to a control member for transmitting mechanically to the control member the position of said fork (11) based on the position of said release member (6).

* * * * *